US007345660B2

(12) United States Patent
Mizukoshi et al.

(10) Patent No.: US 7,345,660 B2
(45) Date of Patent: Mar. 18, 2008

(54) CORRECTION OF PIXELS IN AN ORGANIC EL DISPLAY DEVICE

(75) Inventors: Seiichi Mizukoshi, Kanagawa (JP); Nobuyuki Mori, Sakae-cho (JP); Kouichi Onomura, Yokohama (JP); Makoto Kohno, Tsuzuki-ku (JP)

(73) Assignee: Eastman Kodak Company, Rochester, NJ (US)

( * ) Notice: Subject to any disclaimer, the term of this patent is extended or adjusted under 35 U.S.C. 154(b) by 641 days.

(21) Appl. No.: 10/748,007

(22) Filed: Dec. 30, 2003

(65) Prior Publication Data

US 2004/0150592 A1 Aug. 5, 2004

(30) Foreign Application Priority Data

Jan. 10, 2003 (JP) ..... 2003-005054
Mar. 19, 2003 (JP) ..... 2003-076422

(51) Int. Cl.
*G09G 3/30* (2006.01)

(52) U.S. Cl. ..... 345/77; 345/76

(58) Field of Classification Search ..... 345/76–78, 345/82, 83; 315/169.3
See application file for complete search history.

(56) References Cited

U.S. PATENT DOCUMENTS 5,818,405 A * 10/1998 Eglit et al. ..... 345/88
6,329,980 B1 * 12/2001 Uehara et al. ..... 345/204
6,501,230 B1 * 12/2002 Feldman ..... 315/169.3
7,030,847 B2 * 4/2006 Kimura ..... 345/92
2003/0085906 A1 * 5/2003 Elliott et al. ..... 345/613
2003/0103058 A1 * 6/2003 Hellen Brown Elliott et al. ..... 345/589
2004/0239595 A1 * 12/2004 Vulto et al. ..... 345/76

FOREIGN PATENT DOCUMENTS

JP 11-282420 10/1999

* cited by examiner

*Primary Examiner*—Ricardo Osorio
(74) *Attorney, Agent, or Firm*—Raymond L. Owens

(57) ABSTRACT

An organic electroluminescent display device in which display pixels containing organic electroluminescent elements are arranged in a matrix, comprising:

a correction value formula storage section for storing a correction value formula or coefficients thereof that prescribes a relationship of pixel positions for display and brightness correction data of those pixels;

a correction value output section for receiving the input of data for the positions of respective pixels, and outputs correction values for the respective pixels using the correction value formula or coefficients thereof stored in said correction value formula storage section; and the correction value output section corrects brightness data for each pixel using the correction value from said correction value output section according to the pixel position, to thereby perform display to the respective display pixels.

3 Claims, 5 Drawing Sheets

CORRECTION OF PIXELS IN AN ORGANIC EL DISPLAY DEVICE

FIELD OF THE INVENTION

The present invention relates to an organic EL (electroluminescent) display device formed by arranging organic EL elements or pixels in matrix form, and more particularly to non-uniformity correction of the elements or pixels.

BACKGROUND OF THE INVENTION

FIG. 1 shows a configuration example of a circuit (pixel circuit) for driving one pixel of an active type organic EL display device. A drain of a p-channel driving TFT 1 with a source connected to a source line PVdd is connected to an anode of an organic EL element 3, and a cathode of the organic EL element 3 is connected to a cathode source CV. A source of an n-channel selection TFT 2 is connected to a gate of the driving TFT 1, a drain of this selection TFT 2 is connected to a data line Data, and a gate is connected to a gate line Gate. Furthermore, one end of a holding capacitor C is connected to a gate of the driving TFT 1, and the other end is connected to a capacitor power source line Vsc.

Consequently, the data signal is accumulated in the holding capacitor C by making the gate line extending in the horizontal direction an H level, and switching on the selection TFT 2, and in this condition overlaying a data signal having a voltage corresponding to display brightness onto the data line Data which extends in the vertical direction. As a result, the driving TFT 1 supplies a driving current corresponding to the data signal to the organic EL element 3, so that the organic EL element 3 emits light.

Here, the light emission amount and the current of an OLED element are approximately proportionately related. Normally, a voltage (Vth) such that a drain current starts to flow in the vicinity of the black level of the image is applied between the PVdd and the gate of the driving TFT 1. Furthermore, an amplitude to give a predetermined brightness in the vicinity of the white level, is applied as the amplitude of the image signal.

FIG. 2 shows the relationship of current icv (corresponding to brightness) flowing in the organic EL element 3 with respect to voltage Vgs between the gate and source of the driving TFT 1 (the difference between the voltage of the data line Data and the power source PVdd). By determining a data signal such that Vth is applied as the black level voltage, and Va is applied as the white level voltage, appropriate tone control in the organic EL element 3 can be performed.

Here, the organic EL display device includes a display panel with a plurality of pixels arranged in matrix form. Therefore, as a result of problems in manufacture, Vth varies for each of the pixels, and even on one display panel, the optimum black level varies for each pixel. As a result, the light emission amount with respect to the data signal (input voltage) is non-uniform for each pixel, so that brightness unevenness occurs. Regarding this variation in Vth, cases where this changes randomly for each pixel are few, but there still are instances where this changes gradually over the whole display screen. In this case, even if the same voltage is input to all of the pixels, the brightness gradually changes as shown in FIG. 3. That is to say, in this example, in the x-direction, the right side is darker, and in the y-direction, the bottom side is darker. Consequently, this gives an image where the bottom right is dark and the top left is bright.

Moreover, in the case where the unevenness for each of the horizontal or vertical lines is significant, this appears as stripes for the respective directions.

It has also been proposed to measure the brightness of the respective pixels, and perform a correction for all of the pixels in accordance with the correction data stored in memory. See Japanese Patent Laid-Open No. Hei 11-282420.

However, in the method of this patent publication 1, there are problems in that brightness measurement is not easy with a display panel where there are a large number of pixels, and the capacity of the memory must be large. Furthermore, it is generally difficult to measure the brightness of the pixels with good accuracy and in a short time.

SUMMARY OF THE INVENTION

It is therefore an object of the present invention to efficiently perform brightness correction. This object is achieved by an organic electroluminescent display device in which display pixels containing organic electroluminescent elements are arranged in a matrix, comprising:

a correction value formula storage section for storing a correction value formula or coefficients thereof that prescribes a relationship of pixel positions for display and brightness correction data of those pixels;

a correction value output section for receiving the input of data for the positions of respective pixels, and outputs correction values for the respective pixels using the correction value formula or coefficients thereof stored in said correction value formula storage section; and the correction value output section corrects brightness data for each pixel using the correction value from said correction value output section according to the pixel position, to thereby perform display to the respective display pixels.

Since the correction value formula or the coefficients thereof is stored, the pixel data can be corrected using a reduced amount of data.

This object is also achieved by an organic electroluminescent display device in which display pixels containing organic electroluminescent elements are arranged in a matrix, comprising:

a correction value storage section for storing line positions for either of horizontal or vertical display directions and brightness correction data for pixels of those line positions;

a correction value output section for receiving the input of data for the positions of respective pixels and outputting correction values for the respective pixels based on a relation of the line positions for the respective pixels stored in said correction value storage section and the correction value; and the correction value output section corrects brightness data for each pixel using the correction value from said correction value output section according to the pixel position, to thereby perform display to the respective display pixels.

Since correction data for lines are stored, the amount of storage can be reduced compared to storing all of the correction data for each pixel.

This object is also achieved by a method of manufacturing an organic electroluminescent display device in which display pixels containing organic electroluminescent elements are arranged in a matrix, comprising:

selectively illuminating organic electroluminescent elements of display pixels in a predetermined plurality of small areas within a display area in which the display pixels are arranged in a matrix, and detecting a driving current for each of the small areas at this time;

estimating a trend in non-uniformity of brightness of the respective pixels in the overall display area based on the detected driving current for each of the small areas; and storing correction data for correcting image data for each pixel input based on the estimated trend in non-uniformity of brightness.

The trend in variations for the whole screen can be obtained from the driving current for each small area, thus simplifying corrections.

Furthermore, the correction data is preferably a correction value formula which prescribes a relationship of pixel positions for display and brightness correction data of those pixels.

Preferably the small area is a line for either of the horizontal or vertical display directions, and the correction data is brightness correction data for the pixels in the line.

By thus incorporating a circuit for establishing the correction value formula and/or the correction value into the display device, the correction value formula and/or the correction value can be individually configured on a device by device basis.

DESCRIPTION OF THE PREFERRED EMBODIMENTS

A display panel is formed on a standard glass substrate, pixel circuits are arranged in matrix form on a display area, and driving circuits are arranged around the periphery thereof. The pixel circuits are produced, for example, by fabricating TFTs and wiring and the like on a glass substrate by a standard technique for fabricating semiconductor integrated circuits, and then forming pixel electrodes such as ITOs, and laminating an organic layer and cathode on top.

In the case where the display panel is manufactured as described above, a power source is connected, and the total current icv flowing in the organic EL element is measured. That is, as shown in FIG. 4, a power source voltage PVdd is supplied to respective power source lines PVdd of a display panel 10, and a total current Icv which a power source CV causes to flow from a common cathode to all the organic EL elements is measured by a current detector 12, and a correction value formula is produced as described hereunder from the obtained detection results.

(i) At first, a signal such that the same voltage is applied to all the pixels of the display panel 10 is used, and the CV current is measured while changing this voltage. Since the average current (icv) for the pixels becomes a value that is this CV current divided by the total pixel number, the relationship of the average pixel current icv to the input voltage is plotted. As a result, the relationship as shown by (a) of FIG. 5 is obtained. It should be noted that a signal such that the same voltage is applied to all pixels in a representative small area (for example, a portion of [5] of FIG. 4) rather than all the pixels of the display panel 10 may be used, and the CV current may be measured while changing the voltage to thereby obtain the relationship as shown by (a) of FIG. 5.

Figure 1:
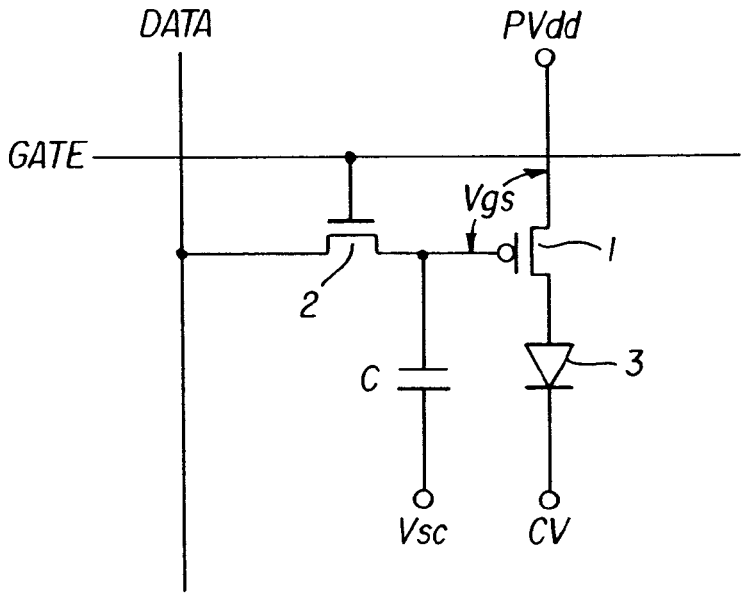
FIG. 1 shows a configuration example of a pixel circuit in an active type organic EL display device.
Figure 2:
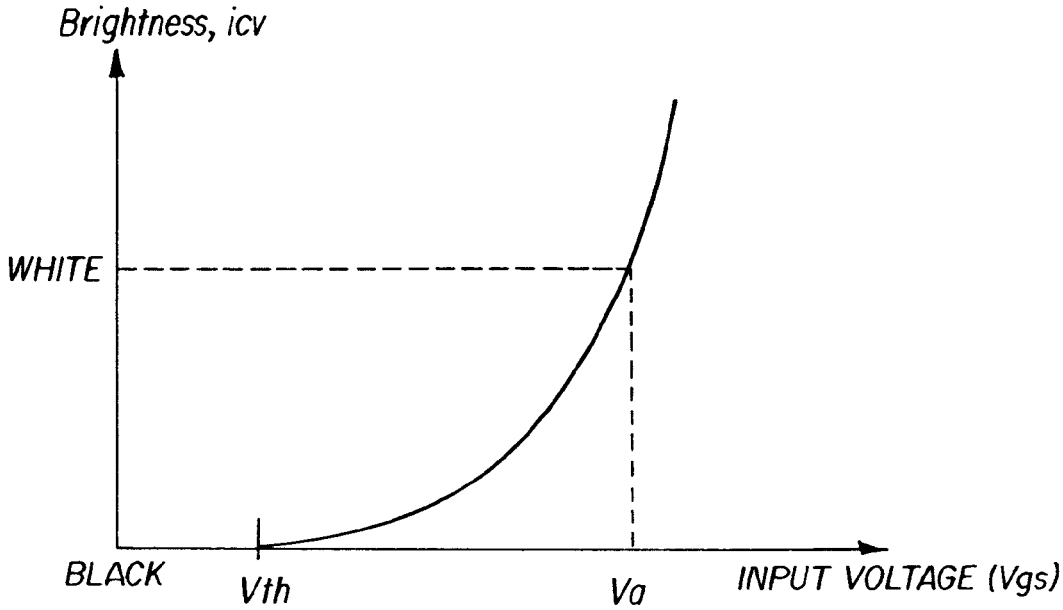
FIG. 2 shows a relationship of brightness and current icv flowing in an organic EL element with respect to voltage Vgs between a gate and source of a driving TFT.
Figure 3:
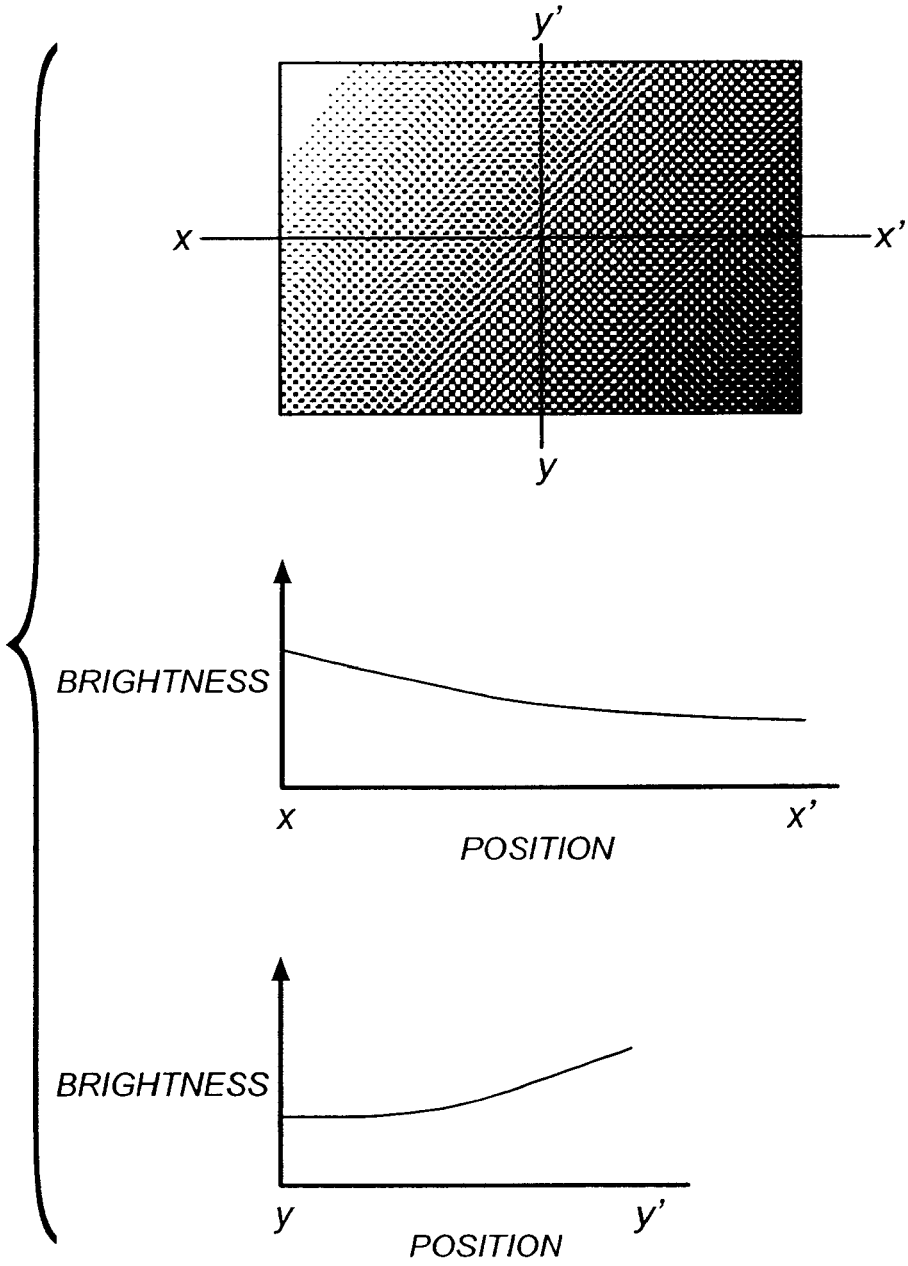
FIG. 3 shows a screen display example where brightness changes gradually.
Figure 4:
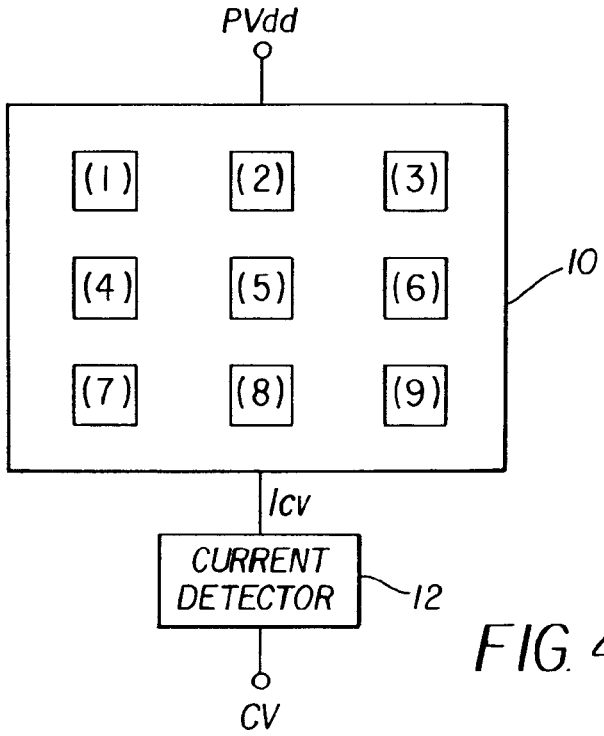
FIG. 4 is a diagram for explaining current detection for each area.
Figure 5:
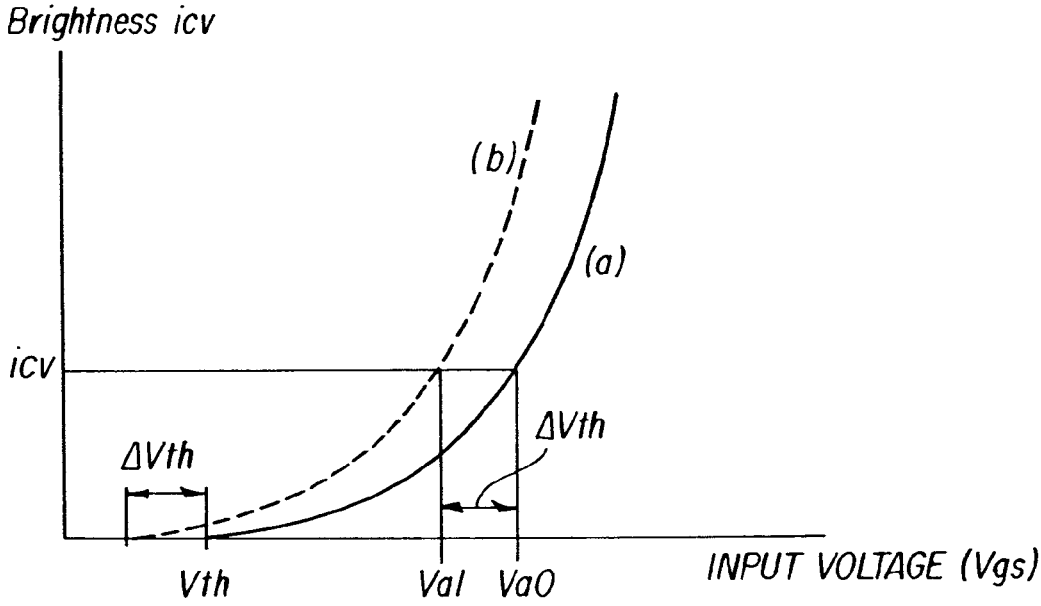
FIG. 5 shows a change in the relationship of brightness and current icv flowing in an organic EL element with respect to voltage Vgs between a gate and source of a driving TFT.

(ii) Next, a signal such that a voltage of Va is applied to only a portion (small area) of [1] of FIG. 4 is used, the CV current Icv at this time is measured, and the measured value is divided by the number of pixels within the small area to thereby obtain the average pixel current (icv) of the small area.

(iii) If it is assumed that the shape of the curve obtained by the above-described procedure (i) is approximately the same for basically any pixel, then the average icv characteristic of the portion of [1] is as in (b) of FIG. 5, and ΔVth is presumed as shown in the figure. That is to say, if the characteristics of the whole display panel are (a), then the average pixel current icv corresponds to the input voltage VaO. However, in measuring the small area of [1], the input voltage Val corresponds to the average pixel current icv, so there is a difference of ΔVth=Val−VaO. Therefore, it is assumed that the characteristic (b) is the characteristic (a) parallel displaced by ΔVth to the left.

(iv) The ΔVths in the small areas of [2] to [9] in FIG. 4 are obtained similarly.

(v) Based on the results of the nine ΔVths obtained in this manner, an expression for a plane surface which approximates the change in ΔVth is calculated as follows.

$$\Delta Vth = ax + by + c \qquad \text{[Equation 1]}$$

where a, b and c are calculated coefficients, and x and y indicate the position of each pixel in the horizontal direction and vertical direction.

Since the expression for the plane surface (correction value formula) sought in this manner is obtained, this correction value formula, or the coefficients a, b and c thereof is stored in a nonvolatile memory (for example a flash memory) inside the device. In the case where the coefficients a, b and c are stored, the coefficients are read out, and are substituted in an expression in a program to obtain the correction value formula.

Figure 6:
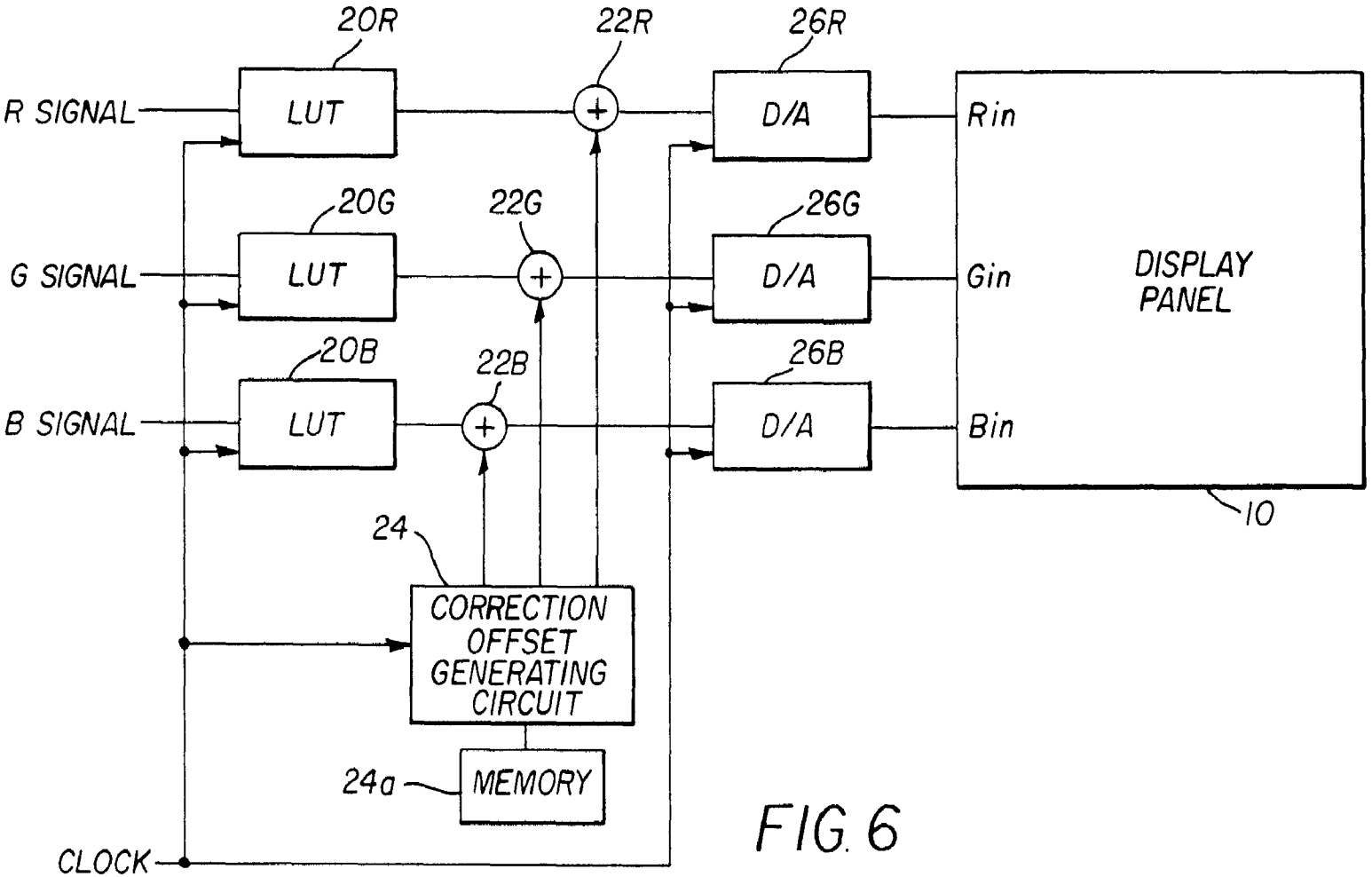
FIG. 6 is a block diagram showing a configuration example of a correction circuit.

Then, when performing display, the black level of the input signal is changed in accordance with this correction value formula. FIG. 6 is an example of a block diagram of a correction circuit.

The display panel 10 has a pixel for each color of RGB, and display data signals are input separately for each color of RGB. For example, by arranging the pixels in such a manner that pixels of the same color are arranged in the vertical direction, any of the data signals for RGB is supplied to the respective data lines, to execute display for each color. The signals for RGB are each brightness signals of 8 bits.

The R signal is supplied to a look up table LUT 20R, the G signal is supplied to a look up table LUT 20G, and the B signal is supplied to a look up table LUT 20B. These look up tables LUT 20R, 20G, and 20B store table data for gamma correction carried out to make a curve of brightness (current) with respect to image data become a desired curve, taking into consideration the characteristic (a) in FIG. 5. Instead of the look up tables, characteristic expressions may be stored, and the input voltage may be converted by calculation. The outputs of the look up tables LUT 20R, 20G and 20B are each widened to a bit width of 10 bits. A clock synchronized with the input data is supplied to the look up tables LUT 20R, 20G and 20B, and the outputs from the look up tables LUT 20R, 20G and 20B are also synchronized with this clock.

The outputs from the look up tables LUT 20R, LUT 20G and LUT 20B are supplied to adders 22R, 22G and 22B. Correction values from a correction offset generating circuit 24 are respectively supplied to these adders 22R, 22G and 22B.

This correction offset generating circuit 24 stores the aforementioned correction value formula $\Delta Vth=ax+by+c$ (or the coefficients a, b, c). Then, in accordance with the supplied clock, the pixel position x, y of the data signal is recognized, and the $\Delta Vth$ corresponding to this is output. Here, the $\Delta Vth$ can be separately generated for each of the RGB, or may be common for RGB.

Then, this correction value $\Delta Vth$ is supplied to each of the adders 22R, 22G and 22B where it is added. As a result, the image data after gamma correction taking into consideration the characteristic (a) of FIG. 5 obtained from all pixels, which is output from the look up tables LUT 20R, 20G and 20B, is converted to a characteristic corresponding to the display pixel position (for example the image data after gamma correction taking into consideration the characteristic (b)). This correction corresponds to where the black level is shifted. Here, the output correction value from the correction offset generating circuit 24 is 10 bits, and the bit width of the adders 22R, 22G and 22B becomes 10 bits.

The outputs of the adders 22R, 22G and 22B are supplied to D/A converters 26R, 26G and 26B, and converted to analog signals, and supplied to input terminals Rin, Gin and Bin for each of the colors of the display panel 10. Then, the data signals corrected corresponding to the pixel positions for each of these colors are supplied to the data line Data, and in the pixels, the EL elements are driven by currents corresponding to the data signals.

In this manner, the correction offset generating circuit 24 outputs correction data for the positions of the pixels in accordance with this correction value formula. Therefore, it is not necessary to store the correction data for all of the pixels, and a large memory is not required. In this embodiment, the correction value formula or the coefficients thereof is stored in a memory 24*a*. This memory 24*a* is preferably, as mentioned above, a rewritable nonvolatile memory, such as a flash memory or an EEPROM.

Then, the brightness non-uniformity occurring in the OLED display element due to problems with manufacture can be corrected by means of simple measurement and a comparatively simple external circuit.

Instead of measuring the brightness for each of the pixels, the CV current when the pixels of a small area (small area can be a plurality of pixels in a predetermined region, or one pixel) emit light is detected to thereby obtain the average Vth for the small area of pixels. Then, based on this measurement result, an approximation formula (correction value formula) for computing the correction value is obtained. This is then stored, and correction of the data signal is performed in accordance with this correction value formula. That is to say, rather than storing all of the correction values for the respective pixels in the memory, in the organic EL display device, the brightness or the current for some portions of the screen is measured, and an approximate curved surface or plane surface which represents the non-uniformity is calculated.

Then, the expression for this curved surface or plane surface, or coefficients thereof, is held in a nonvolatile memory inside the device, and when displaying, this formula is used to correct the input signals. As a result, non-uniformity of the display over the whole screen can be effectively corrected.

Moreover, as a form of unevenness of the display on the screen, there is unevenness for each of the horizontal or vertical lines. In this case, stripes in the horizontal or vertical direction appear on the screen.

In the present embodiment, to counter this unevenness in the horizontal and vertical directions, one line or a plurality of lines are set for one small area, the CV current for each of these small areas is measured, and the correction value is stored for each or a plurality of lines.

The circuit configuration for this may be exactly the same as for the aforementioned embodiment, where the correction offset generating circuit 24 generates a corresponding offset value $\Delta Vth$ in accordance with the supply line number, and adds this in the adders, 22R, 22G and 22B, to perform a correction which shifts all of the characteristics.

Here, a correction procedure for regular side by side unevenness for each of the horizontal lines will be explained.

(i) A signal such that the same voltage is applied to all of the pixels of the display panel is used, and the relationship between this voltage and the CV current is measured. Since the average current (icv) for the pixels becomes a value that is this CV current divided by the total pixel number, the relationship of icv to the input voltage is plotted. That is to say, the data of the characteristic (a) of FIG. 5 is obtained. It should be noted that a signal such that the same voltage is applied to all pixels on a representative line or a small area as described above other than all the pixels of the display panel 10 may be used, and the CV current may be measured while changing the voltage to thereby obtain the relationship as shown by (a) in FIG. 5.

(ii) A signal such that the voltage of Va0 is applied to a specific one line or a plurality of lines is used, the CV current (Icv) at this time is measured, and the average current (icv) of the respective pixels is obtained.

(iii) Assuming that the shape of the curve obtained by the above-described procedure (i) is approximately the same for basically any pixel, then $\Delta Vth$ is obtained as shown in FIG. 5. That is to say, $\Delta Vth$ is obtained from the difference of the input voltage value corresponding to the specific average CV current icv, and the input voltage in the characteristic (a) corresponding to this icv.

(iv) The $\Delta Vths$ for the remaining display portions are also obtained similarly.

(v) Based on the aforementioned results, the average $\Delta Vth$ for each of the lines or several lines is obtained, and this is stored in the memory of the display device.

Then, when displaying an image, the corresponding $\Delta Vth$ in accordance with the line position of the pixels is read out from memory and the input value is corrected. This correction involves performing offset of the pixel signal, and corresponds to a shift of the black level.

For the device configuration, the arrangement as shown in FIG. 6 may be used as it is, with the relationship between the line position and the correction value stored in the correction offset generating circuit 24, and the correction value $\Delta Vth$ of this line position output in accordance with the pixel position of the input pixel signal and this added by the adders 22R, 22G and 22B.

In this manner, with this embodiment also, since the correction data for each of one or a plurality of lines may be stored, the capacity of the memory can be smaller compared to storing the correction data for all of the pixels. Moreover, since measurement of the driving current is used in producing the data, the operation is simple compared to measurement of the brightness.

Further, the unevenness which regularly appears in the vertical direction can also be corrected in an analogous fashion.

Figure 7:
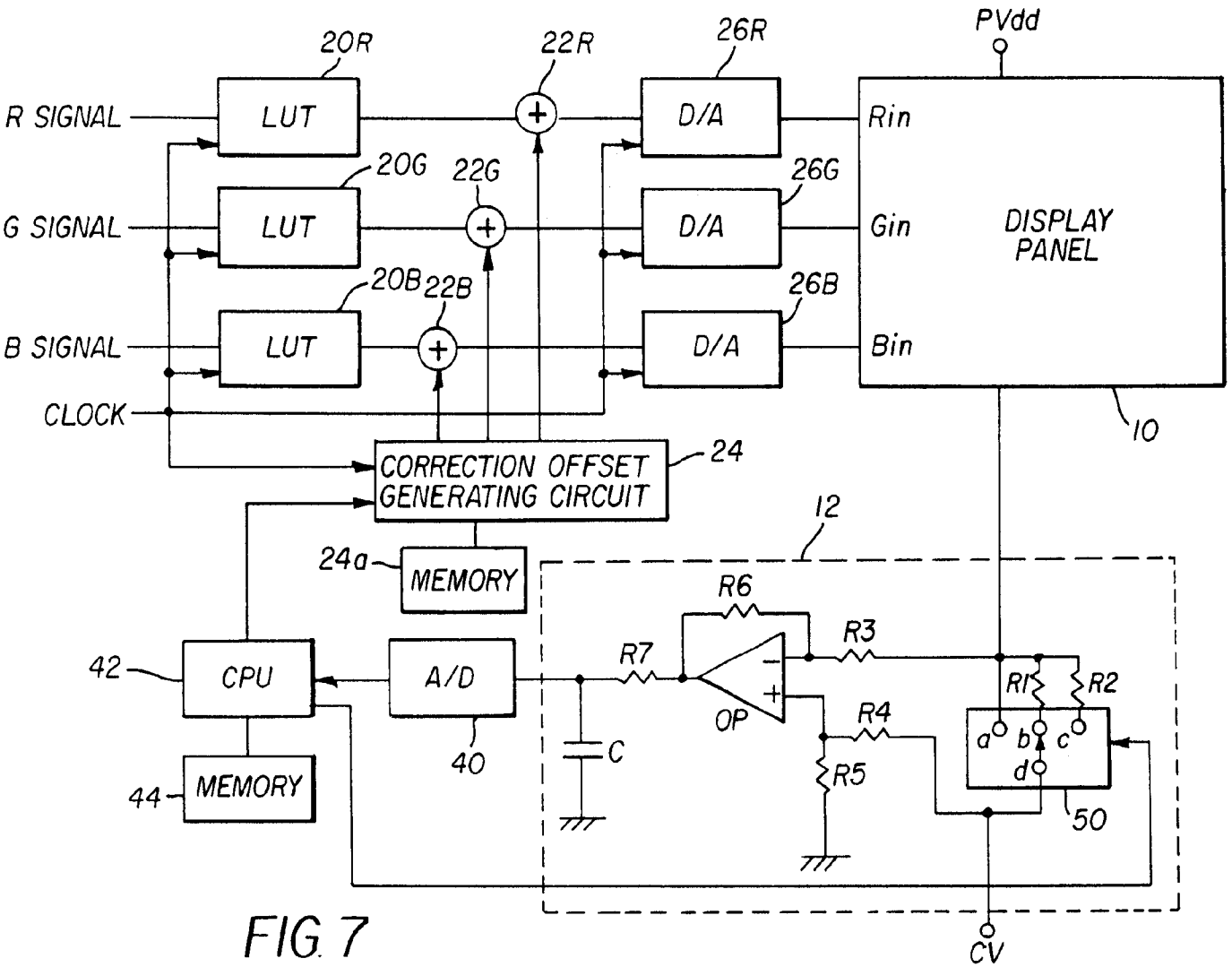
FIG. 7 is a block diagram showing a structure of an EL display device including a configuration for determining a correction formula and/or a correction value, and others.

FIG. 7 shows an example structure in which a circuit for applying correction as described above is incorporated into a product itself. In this structure, the display panel 10 is, on the positive side thereof, connected to the power source PVdd and, on the negative side thereof, connected to the low-voltage power source CV as in the case of FIG. 4, and the current detector 12 is placed between the display panel 10 and the low-voltage power source CV.

The values detected by the current detector 12 are converted into digital data in an A/D converter 40 and then provided to a CPU 42, which is a microprocessor for controlling various operations of the organic EL display device. The CPU, to which a memory 44 for storing necessary data as appropriate is connected, also executes procedures for offset control in accordance with the values detected by the current detector 12 as described in the above embodiment.

The configuration of the current detector 12 in the figure will be described below. The negative side of the display panel 10 is input to a switch 50 comprising one output terminal d connected to the low-voltage power source CV and three other input terminals a, b, and c, either one of which is selectively connected to the power source CV. Switching of the switch 50 is controlled by the CPU 42. The negative side of the display panel 10 is connected to the three input terminals a, b, and c. More specifically, the negative side is directly connected to the input terminal a, and connected to the input terminal b through a resistor R1 and to the input terminal c through a resistor R2, respectively.

The CPU 42 selects the input terminal a normally. On the other hand, in the case where the process for correction is carried out, the CPU 42 selects the input terminal b for emission of small area and selects the input terminal c for emission of one line in the horizontal or vertical direction. Accordingly, a voltage drop in the current detector 12 is substantially 0 normally. Because the number of organic EL elements in a small area is greater than that on one line, by establishing the resistor R2 so as to have a greater resistance value than the resistor R1, an upper voltage of the resistor R1, R2 at selection of the input terminal b, c can be set to a similar value.

The upper sides of the resistors R1 and R2 (the connection side to the display panel 10) are connected to a negative input end of an operational amplifier OP via a resistor R3. Because a positive input end of the operational amplifier OP is connected to the low-voltage power source CV via a resistor R4 as well as a ground via a resistor R5, a positive input terminal of the operational amplifier OP is maintained at a voltage determined from the ground, CV voltage, and resistors R4 and R5. Further, a negative input terminal of the operational amplifier OP is connected to an output terminal thereof through a feedback resistor R6 provided in-between. Accordingly, the operational amplifier OP produces an output such that the upper voltage of the resistor R1, R2 is amplified at a rate determined by the resistor R3, R6 relative to a voltage of the positive input terminal.

The output end of the operational amplifier OP is connected to one end of a resistor R7, the other end of which is connected to the A/D converter 40 and connected to ground through a condenser C. Therefore, the output of the operational amplifier OP is smoothed in an integrator circuit consisting of the resistor R7 and the condenser C, and then the smoothed voltage is input to the A/D converter 40.

As described above, a current value of the display panel 10 is provided to the CPU 42 in this embodiment.

The CPU 42 then controls the switch 50 at appropriate timing to detect the amount of current passing through the display panel 10. For example, at power-on, at the time of initiating product use, and at the time of reset, the CPU 42 executes the current detection operation. More specifically, the CPU 42 controls the switch 50 to select the input terminal b, and then sequentially executes predetermined emission on a small area basis. The amount of panel current is detected at each emission of the small areas. Based on the state of the detected amounts of current, the correction value formula or the coefficients thereof is calculated, and provided to the correction offset generating circuit 24, and then stored in the memory 24*a*. Further, the amount of panel current is measured at each emission of the lines in a state where the input terminal c is selected in the switch 50.

As the data for calculating the correction value formula is obtained in the above-described manner, the CPU 42 recognizes display status of the display panel 10 based on the data, and calculates the correction value formula or the coefficients thereof in accordance with the display status, and then stores the calculation result in the memory 24*a*. Thus, appropriate correction can be achieved in this embodiment as in the case of the previous embodiment. It should be noted that no problem would arise by selecting the input terminal a normally, as described above.

As described above, the structure for detecting the amount of correction offset is incorporated into the product, according to the embodiment depicted in FIG. 7. Such a built-in structure enables the correction value formula or the coefficients thereof to be determined and stored as appropriate when the product is actually used. By specifying such setting as needed, it is possible to adapt to a change in usage conditions, a change due to aging, and others.

Furthermore, the following modifications are also possible.

(i) In the aforementioned example, an expression for a plane surface was used, but an expression for a curved surface may also be used. For example, this may be a higher order polynomial expression with x and y as the variables.

(ii) In relation to $\Delta Vth$, the input voltage for the point where the CV current starts to flow may be regarded as Vth in the measurement.

(iii) Instead of measuring the CV current to estimate the brightness non-uniformity, the brightness may be actually measured.

As described above, according to the present invention, since the correction value formula or the coefficients thereof is stored and the pixel data is corrected using this, the data amount can be reduced compared to storing the correction data for each pixel.

Furthermore, since correction data for the lines is stored, the storage amount can be reduced compared to storing all of the correction data for each pixel.

Moreover, the trend in variations for the whole screen can be obtained from the driving current for each small area, thus simplifying operation.

PARTS LIST

1 P-channel driving
3 EL element
10 display panel
12 current detector
20R look up table LUT
20G look up table LUT
20B look up table LUT
22R adder
22G adder
22B adder
24 correction offset generating circuit
24*a* memory
26R D/A converter
26G D/A converter
26B D/A converter
44 memory

What is claimed is:

1. An organic electroluminescent display device in which display pixels containing organic electroluminescent elements are arranged in a matrix, comprising:

a correction value formula storage section for storing a correction value formula or coefficients thereof and in response to the pixel positions providing correction values for display and brightness correction data of those pixels;

a correction value output section for receiving the input of data for the positions of respective pixels, and correction values produced by the correction values formula storage section;

the correction value output section corrects brightness data for each pixel using the correction value and the pixel position, and to display the corrected display pixels;

an emission controller for selectively illuminating organic electroluminescent elements of display pixels in a predetermined plurality of small areas within the display area wherein display pixels are arranged in a matrix;

a current detector for detecting a driving current for each of the small areas at the time of selective emission of the small areas;

a correction value formula generator for estimating a trend in non-uniformity of brightness of the respective pixels in the overall display area based on the detected driving current for each of the small areas and determining said correction value formula or coefficients thereof based on the estimated trend in non-uniformity of brightness; and wherein the correction value formula, or coefficients thereof, determined by said correction value formula generator is stored in said correction value formula storage section.

2. An organic electroluminescent display device in which display pixels containing organic electroluminescent elements are arranged in a matrix, comprising:

a correction value storage section for storing line positions for either of horizontal or vertical display directions and brightness correction data for pixels of those line positions;

a correction value output section for receiving the input of data for the positions of respective pixels and outputting correction values for the respective pixels based on a relation of the line positions for the respective pixels stored in said correction value storage section and the correction value; and the correction value output section corrects brightness data for each pixel using the correction value from said correction value output section according to the pixel position, and to display the corrected display pixels.

3. An organic electroluminescent display device according to claim 2, further comprising:

an emission controller for selectively illuminating organic electroluminescent elements of display pixels on predetermined lines in either horizontal or vertical direction within the display area wherein display pixels are arranged in a matrix;

a current detector for detecting a driving current for each of the lines at the time of selective emission of the lines;

corresponding relationship determination means for obtaining a corresponding relationship between the position of a line and a correction value for pixels on the line based on the detected driving current for each of the predetermined lines; and wherein the correction values provided by the corresponding relationship determination means are stored in said correction value storage section.

* * * * *